United States Patent [19]

Hartzler et al.

[11] 4,099,037

[45] Jul. 4, 1978

[54] KEY BOARD SWITCH ASSEMBLY HAVING CANTI-LEVERED LEAF SPRING CONTACT ASSEMBLY ON COMMON CONDUCTIVE FRAME

[75] Inventors: Earnest D. Hartzler, San Jose; Paul D. Levesque, Mountain View, both of Calif.

[73] Assignee: National Semiconductor Corporation, Santa Clara, Calif.

[21] Appl. No.: 697,806

[22] Filed: Jun. 21, 1976

[51] Int. Cl.[2] ..... H01H 13/70

[52] U.S. Cl. ..... 200/5 A; 200/159 A; 200/275

[58] Field of Search ..... 200/5 R, 5 A, 67 D, 200/67 DA, 67 DB, 159 R, 159 A, 159 B, 275; 84/433

[56] References Cited

U.S. PATENT DOCUMENTS

| | | | |
|---|---|---|---|
| 3,600,528 | 8/1971 | Leposavic | 200/5 A |
| 3,742,157 | 6/1973 | Leposavic | 200/5 A |
| 3,777,082 | 12/1973 | Hatley et al. | 200/5 A |
| 3,800,104 | 3/1974 | Lien et al. | 200/5 A |
| 3,849,611 | 11/1974 | Walker, Jr. | 200/16 A X |
| 3,858,019 | 12/1974 | Muri et al. | 200/5 A X |
| 3,870,840 | 3/1975 | Rivetta et al. | 200/275 X |
| 3,909,564 | 9/1975 | Scheingold et al. | 200/5 A X |
| 3,996,429 | 12/1976 | Chu et al. | 200/5 A X |

*Primary Examiner*—James R. Scott
*Attorney, Agent, or Firm*—Brown & Martin

[57] ABSTRACT

A push button panel having twelve push buttons arranged in three columns of four push buttons per column. A push button panel of the type described wherein a common signal is connected to the unique combination of two out of seven circuit paths when a given push button is depressed. The panel has a minimum number of individual parts and employs lead frame techniques to facilitate fabrication of the parts in a rapid manner according to well understood procedures. A push button panel arranged to optimize the spring characteristics of the members so as to minimize the likelihood of false signals without requiring excessive force to operate the push buttons.

7 Claims, 6 Drawing Figures

Fig-1
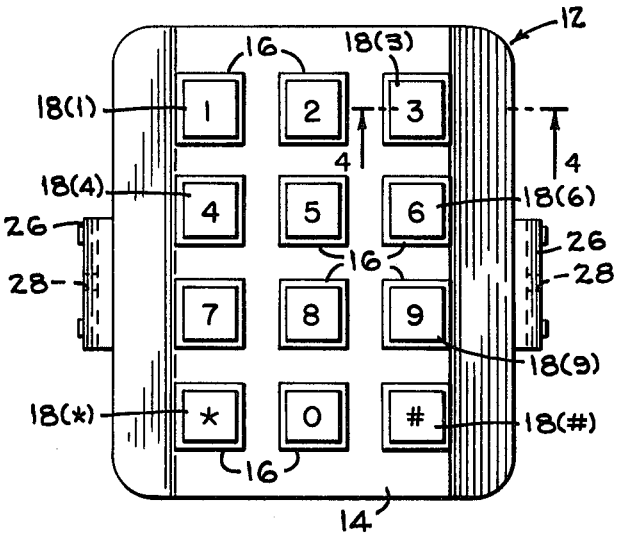
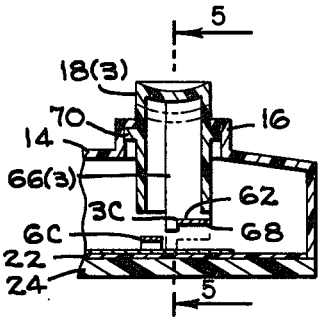
Fig-4
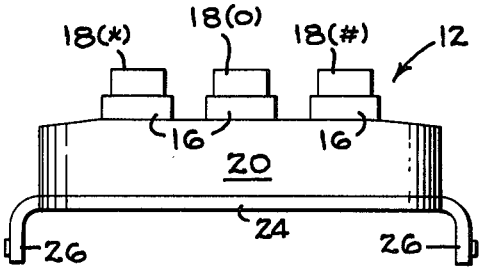
Fig-2
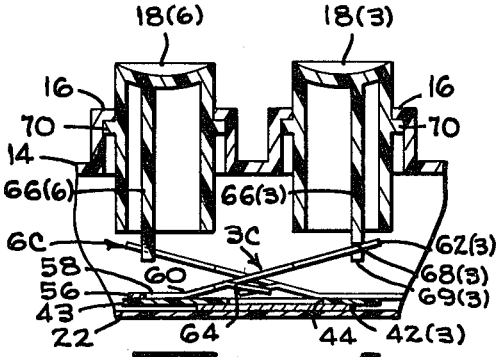
Fig-5
Fig-3
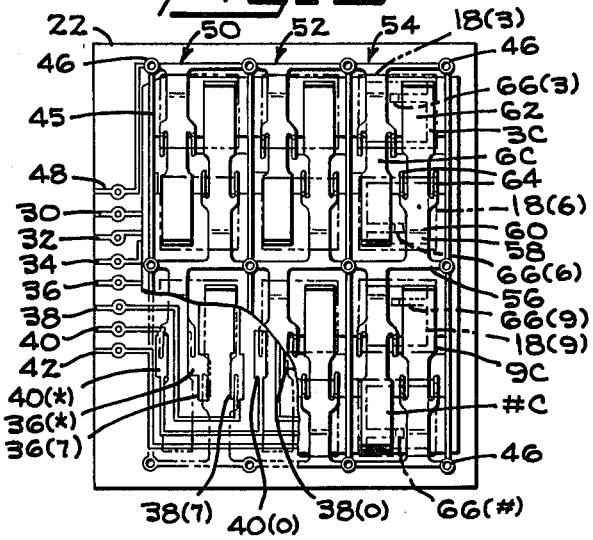
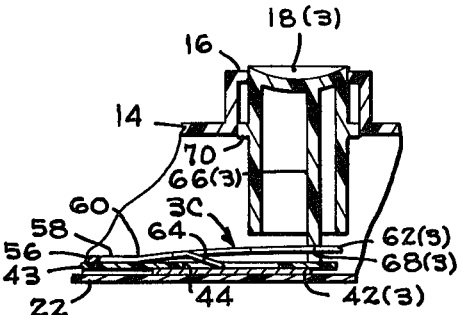
Fig-6

KEY BOARD SWITCH ASSEMBLY HAVING CANTI-LEVERED LEAF SPRING CONTACT ASSEMBLY ON COMMON CONDUCTIVE FRAME

BACKGROUND OF THE INVENTION

1. Field of the Invention

This invention relates to push button switches of the momentary contact type such as are used in data input panels.

2. Description of the Prior Art

One type of push button panel employed in connecting a common signal to two out of seven circuits employs seven spring contact sets which are mechanically operated by a mechanical cam arrangement activated by depressing a push button. Although such prior art panels have proved to operate well in practice, they are extremely expensive in that they are composed of a large plurality of small and delicate independent mechanical parts which require substantial assembly time during fabrication.

U.S. Pat. No. 3,909,564 discloses a push button panel which avoids the mechanical arrangement referred to above.

SUMMARY OF THE INVENTION

In the embodiment of the present invention that is described in more detail hereinafter there is an insulative substrate on which are disposed by means of printed circuit techniques twelve pairs of fixed electric contacts arranged in three columns of four pairs per column and which pairs of contacts are electrically arranged to form seven electrically independent circuit paths such that each contact pair represents a unique combination of two of the seven circuit paths. Overlying the printed circuit board and the conductive paths is a thin insulative layer having apertures aligned with respective contact pairs. Overlying the thin insulative layer is a conductive spring structure formed in accordance with lead frame techniques and forming twelve spring contact members adapted to establish a connection between respective pairs of fixed contacts which are accessible through the apertures in the insulative sheet. A common electric signal (e.g. ground) can be connected to the lead frame arrangement. Supported above the lead frame arrangement is a cover panel which slidably supports push button bodies and constrains the bodies for reciprocation toward and away from the respective spring contact members. Adjacent spring contact members are reversely oriented relative one another so that a substantial length of the material is deflected in response to depression of one of the push buttons, thereby exploiting in the most advantageous manner the spring characteristics of the material without unduly enlarging the overall size of the panel.

An object of the invention is to provide a push button panel structure formed of a minimum number of parts. This object is achieved according to the invention by exploiting printed circuit and lead frame fabrication techniques so that the moving parts perform the dual function of biasing the push button bodies to an open circuit position and establish the electrical path when the push button bodies are actuated.

A feature and advantage of achieving the above stated object is that the initial expense on the push button structure is materially reduced and the reliability and longevity is materially increased.

Another object of the invention is to so arrange the moveable spring contacts of the panel that the active spring length is increased without increasing the overall size of the panel. This object is achieved by forming the spring contacts in oppositely or reversely extending pairs of juxtaposed members and by forming the push buttons associated with the two spring members with relatively offset spring contacting portions. Thus the push buttons reside in a straight line notwithstanding the respective contacts with which they are associated are laterally offset and spaced from one another.

A further object is to form the spring contacts associated with each of the three columns of four springs in a uniform manner so that a lead frame containing 12 spring contacts can be formed by sequentially punching the material of which the spring contacts are made by a single relatively uncomplex die.

The foregoing, together with other objects, features and advantages, will be more apparent after referring to the following specification and the accompanying drawing.

BRIEF DESCRIPTION OF THE DRAWING

FIG. 1 is a top view of a twelve button panel constructed according to the invention.

FIG. 2 is an end view of the push button structure of FIG. 1.

FIG. 3 is a view of the interior of the panel of FIG. 1 with portions being broken away and shown in phantom lines for clarity.

FIG. 4 is a view taken along a plane designated by line IV—IV of FIG. 1.

FIG. 5 is a cross sectional view taken along a plane designated by line V—V of FIG. 4.

FIG. 6 is a view similar to FIG. 5 showing an alternate position, i.e. with the push button depressed so as to establish electrical contact.

DESCRIPTION OF THE PREFERRED EMBODIMENT

Referring more particularly to the drawing, reference numeral 12 indicates generally a push button panel constructed in accordance with the invention. Push button panel 12 includes a top plate 14 integral with which are twelve substantially identical uniformly spaced shoulders 16 which are configured to constrain a corresponding number of push buttons for reciprocation on paths normal to the plane of plate 14. As seen in FIG. 1 the push buttons have upper walls on which are respectively placed the following indicia: 1, 2, 3, 4, 5, 6, 7, 8, 9, 0, * and #. For clarity in the ensuing description the push buttons will be identified by the reference numeral 18 followed by the parenthetical reference character corresponding to the specific push button. Thus in FIG. 4 there is shown in cross section push button 18 (3).

Circumscribing the periphery of plate 14 and integral therewith is a vertical wall 20 to the lower surface of which is secured an insulative substrate 22. As is clear from FIG. 4, substrate 22 is supported in parallelism with panel 14. Fixed to the lower surface of substrate 22 is a bracket 24 having at opposite ends thereof downward bent mounting plates 26, the mounting plates being provided with mounting holes 28 to effect installation of panel 12 to the equipment with which the panel is used.

On the upper surface of substrate 22 is formed a plurality of conductive paths formed of thin conductive foil material widely employed in printed or etched circuit boards. The conductors are intimately bonded onto the upper surface of substrate 22 and form seven independent electric circuit paths, 30, 32, 34, 36, 38, 40 and 42. Circuit paths 30–42 are configured so that associated with each of the 12 push buttons 18 is a pair of fixed contacts, each pair of fixed contacts forming a unique pair of the circuit paths. For example, associated with push button **18(*) are fixed contacts 40(*) and 36(*) and associated with push button 18(7) are fixed contacts 36(7) and 38(7). Also visible in FIG. 3 is a pair of fixed contacts associated with push button 18(0), the fixed contacts being indicated at 40(0) and 38(0). The circuit paths terminate at the left hand edge of substrate 22 (see FIG. 3**) for connection with circuitry in the equipment with which the panel is employed.

Overlying substrate 22 and circuit paths 30–42 is an insulative layer 43 wich is apertured, such as indicated at 44 in FIG. 5, so as to expose each of the twelve pairs of fixed contacts. Overlying insulative layer 43 is a unitary conductive frame 45 which is secured to substrate 22 by a plurality of spaced apart rivets 46 which extend through frame 45, insulative layer 43 and substrate 22 to retain such parts in assembled condition. Frame 45 is constructed of conductive material having elastic or spring properties for purposes which will become apparent.

Frame 45 is electrically connected to a printed circuit conductor 48 on substrate 22 so that the frame and the latter conductor constitute a common circuit. The frame 45 is composed of three identical sections 50, 52 and 54, each section being identical and corresponding to a vertical column of four push buttons as seen in FIG. 1. Each frame section includes four spring contact members which are associated with respective pairs of fixed contacts in circuit with paths 30–42. Because the respective contacts are associated with respective push buttons, the numeral associated with respective push buttons with the addition of the character C will be employed to identify the spring contacts members. Thus in FIG. 3 it is seen that contacts 3C, 6C, 9C and #C reside in the column 54 of frame 45.

Spring contact member 3C is secured to a cross bar 56 that constitutes a part of frame 45. Cross bar 56, as seen in FIG. 5, resides upon insulative layer 43 and is there retained by rivets 46. Extending from and integral with cross bar 56 and constituting the proximal end of the spring contact member is a leg 58 which extends to a bend line 60. Integral with leg 58 and diverging away from the plane of substrate 22 in an upward direction spring contact member 3C has a main body 62. The outer end of main body 62 constitutes the distal end of the spring contact member. At a position relatively close to bend line 60 there is a pair of moveable contacts 64 integral with main body 62 and bent downward therefrom. As seen in FIG. 5 moveable contacts 64 have an extent and reside at an angle such that the contacts are spaced above the fixed contacts when spring contact member 3C is in a relaxed or unstressed condition. As seen in FIG. 6, however, the angle and length of moveable contacts 64 is such that they bridge the fixed contacts associated with push button 18(3) before the distal end of main body 62 touches the upper surface of insulative layer 43, thereby assuring good electrical continuity between the fixed contacts of the pair associated with push button 18(3).

As seen in FIG. 5 push buttons 18(3) and 18(6), which exemplify all 12 push buttons, each include an integrally molded wall 66 that defines a bearing surface 68 that bears on main body 62 of the associated spring contact member. The push button bodies are otherwise hollow so as to conserve material and to minimize the weight of the body in order that the spring contact member can bias the push button in an upward position in the absence of external force on the push button. It will be noted that the distance between bend line 60 to the point that bearing surface 68 bears against the main body 62 of the associated spring contact member is approximately three times the distance from the bend line to moveable contacts 64 of the spring contact. This relationship of distances together with the spring characteristics of spring contact member 3C operates to require a relatively larger initial force to advance moving contact 64 toward the fixed contacts (thereby reducing the likelihood of false signals) but effects completion of the electric circuit by only a small increase in force to drive the spring arm through its full stroke, i.e. to the position shown in FIG. 6. As seen in FIGS. 4 and 6, wall 66(3) includes an abutment surface 69(3), the abutment surface being disposed distally of bearing surface 68(3) so that travel of the push button body and main body 62(30) of spring contact member 3C is limited (see FIG. 6). Because wall 66 is offset from the mid plane of the push button body in a direction toward the distal end of the associated spring contact member (see FIGS. 5 and 6), interference with the adjacent spring contact member is avoided.

As seen in FIG. 3 spring contact member 3C and spring contact member 6C extend parallel to one another but from opposite directions, a relationship that permits the employment of the relatively long spring arms without increasing the overall dimensions of panel 12 and the distance between adjacent push buttons. To permit alignment of push button 18(3) with push button 18(6), wall 66(6) is oppositely oriented from wall 66(3),. The consequence of such orientation of wall 66(6) with respect to wall 66(3) is that, although the main bodies of the respective push buttons are in alignment as seen in FIG. 1, walls 66 and bearing surfaces 68 of the respective push buttons are offset so as to afford activation of the respective spring contact members associated with the push buttons. A similar offset relationship exists with respect to push buttons 18(9) and 18(#). Thus push button 18(9) includes a wall 66(9) which is offset from wall 66(#) so that the respective spring arms can be independently actuated. This arrangement permits the size of the portion of the push buttons accessible to the user to be sufficiently large for convenient manipulation. From FIG. 3 it can be seen that the horizontal dimension of each push button is about twice the width of the spring contact members and about one-half the length of the members.

The above description of the spring arms in column 54 typifies the arrangement of the spring arms in columns 50 and 52 because each of the columns is identical. This characteristic, in addition to providing an improved push button panel having dimensions corresponding to prior art panels, facilitates fabrication of frame 45. Thus a conventional metal stamping press supplied with a die configured to form one of the columns can be employed to form frame 45 by sequentially feeding sheet stock through the press. In other words, if as seen in FIG. 3 the sheet stock were fed into a die disposed for example at the right hand end of the figure, column 54 would first be formed, the press would be open to afford advancement of the stock, column 52 would be formed, etc. Thus, because of the arrangement of the spring contact members in identical repetitive patterns, substantial economies and efficiencies in fabrication are achieved.

The operation of the apparatus will now be summarized. In the normal position (see FIG. 5) the push buttons are retained in an elevated or outward position by the resilience or elasticity of the spring contact members. The upper extremity of travel of the push buttons is limited by an integral rib 70 on each of the push buttons which contacts the surface of shoulder 16 on panel 14. Contact 48 is typically connected to ground or other similar common connection so that frame 45 and spring contact members 62 thereon reside at such potential. When it is desired to connect such common signal to two of seven circuit paths 30–42, the appropriate push button 18 is depressed. Because of the length of main body 62 of the spring arms a moderate degree of force on the push button is required to move moveable contacts 64 toward the fixed contacts accessible through aperture 44 associated with the push button. Because of the limited lateral extent of wall 66, only one of the spring contact members is activated in response to actuation of one of the push buttons. Abutment surface 69 limits the inner travel of the push button body so that moveable contacts 64 bridge the associated pair of fixed contacts and apply the common signal to the fixed contacts while the outer end of the spring contact member resides in spaced relation above the surface of insulative layer 43. When the push button is released from the position shown in FIG. 6, the energy stored in the spring contact member restores the push button to the upper position shown in FIG. 5.

Thus it will be seen that the present invention provides a push button panel with a minimal number of parts thereby enhancing the reliability of the panel as well as reducing the cost of the same. Because of the presence of spring contact membrs in oppositely extending pairs, the length of the spring contact members can be substantially lengthened without increasing the overall size of the panel or the distance between adjacent push buttons. Finally because frame 45 is formed of three identical columns, it can be produced on well known die cutting equipment with reliability and economy. Although one embodiment of the invention has been shown and described, it will be obvious that other adaptations and modifications can be made without departing from the true spirit and scope of the invention.

What is claimed is:

1. A push button keyboard switch assembly having at least first and second push button bodies for effecting selective momentary circuit closures comprising:

an insulative substrate, a plurality of conductive circuit paths on said substrate forming first and second spaced apart fixed contacts, first and second spaced apart fixed contacts, first and second elongate conductive spring members, each said conductive spring member having a distal and a proximal end, means for securing the respective proximal ends on said substrate at oppositely disposed points so that the elongate spring members reside in mutually parallel relation and span respective fixed contacts in opposite directions with the proximal end of said first conductive spring member adjacent the distal end of said second conductive spring member, each said spring member adjacent the proximal end thereof being bent upward so that the majority of the respective spring members diverge upward from the substrate toward the respective distal ends, each said spring member intermediate the ends thereof having at least one contact point in alignment with said fixed contact points, means for constraining said push button bodies for movement toward and away from said substrate along paths aligned with the distal ends of respective said conductive spring members, said first push button body having a wall defining a first bearing surface for bearing on the distal end of said first conductive spring member and a second push button body having a wall defining a second bearing surface for bearing on the distal end of said second conductive spring member, said walls being laterally offset from one another so that said bearing surfaces bear on respective said conductive spring members, said push button bodies being aligned with one another in a direction longitudinally of said conductive spring members, said walls further defining stop members for limiting the movement of said push buttons toward said substrate by contact of said walls with said substrate.

2. A push button keyboard switch assembly according to claim 1 wherein:

each conductive spring member having first and second laterally spaced contact points, each of said fixed contacts comprising laterally spaced apart fixed contact pairs, said contact pairs being aligned with the respective contact point.

3. The push button keyboard switch assembly according to claim 2 further including:

an insulative layer overlying said conductive circuit paths and defining first and second apertures for exposing respective fixed contact pairs.

4. The push button keyboard switch assembly according to claim 2 wherein:

said push button comprises an insulative body having an externally accessible surface, said push button body including a side wall normal to said externally accessible surface, said side wall defining a central cavity, said wall defining said second bearing surface residing within said cavity.

5. The push button keyboard switch assembly according to claim 1 wherein:

said movable contacts are spaced from said proximal end by a distance approximately one-third the distance of said proximal end to said distal end so that the portion of said spring contact member distally of said movable contacts moves toward said substrate in response to a force from said push button before said movable contact moves toward said substrate.

6. The push button keyboard switch assembly according to claim 1 wherein:

said proximal end includes securing means comprising a rivet extending through said substrate, said insulative layer and said proximal end.

7. The push button keyboard switch assembly according to claim 1 further comprising:

a column of at least four push buttons disposed in uniformally spaced apart relation along a straight line comprising first and second pairs of push buttons, first and second pairs of parallelly spaced apart spring contact members secured on said substrate and symmetrically disposed relative said straight line, each of said spring contact members being associated with a discrete one of said push buttons.

* * * * *